United States Patent [19]

Baikoff

[11] 4,241,882

[45] Dec. 30, 1980

[54] COMMINUTING MACHINE

[76] Inventor: Eugene M. A. Baikoff, ch. Anciens Moulins 2A, 1009 Pully (Canton of Vaud), Switzerland

[21] Appl. No.: 48,239

[22] Filed: Jun. 13, 1979

[30] Foreign Application Priority Data

Jun. 20, 1978 [CH] Switzerland ..... 6701/78

[51] Int. Cl.[3] ..... B02C 18/18

[52] U.S. Cl. ..... 241/236; 241/191; 241/295; 241/DIG. 31

[58] Field of Search ..... 241/191, 197, 236, 294, 241/295, DIG. 31

[56] References Cited

U.S. PATENT DOCUMENTS

| | | | |
|---|---|---|---|
| 1,058,948 | 4/1913 | Clark | 241/295 |
| 2,986,349 | 5/1961 | Boron | 241/294 X |
| 3,367,585 | 2/1968 | Ratkowski | 241/197 |
| 3,991,944 | 11/1976 | Baikoff | 241/236 X |

*Primary Examiner*—Howard N. Goldberg
*Attorney, Agent, or Firm*—Pollock, Vande Sande and Priddy

[57] ABSTRACT

A machine intended for comminuting objects which are bulky and/or resistant to destruction comprises two shafts bearing comminutor rings disposed alternatingly along each of the shafts. The rings are formed of separate elements, at least some of which are comminutor elements having comminutor noses. The elements each have an inverted-U profile and are secured to the shafts by fitting over shaft-collars integral with the shafts. Journal-and-screw assemblies passing through precision bores in the sidewalls of the elements and in the shaft-collars firmly fix the elements to the shaft-collars, and thus to the shafts. The comminuting machine is very sturdy and withstands very high axial mechanical stresses.

8 Claims, 5 Drawing Figures

Figure 2:
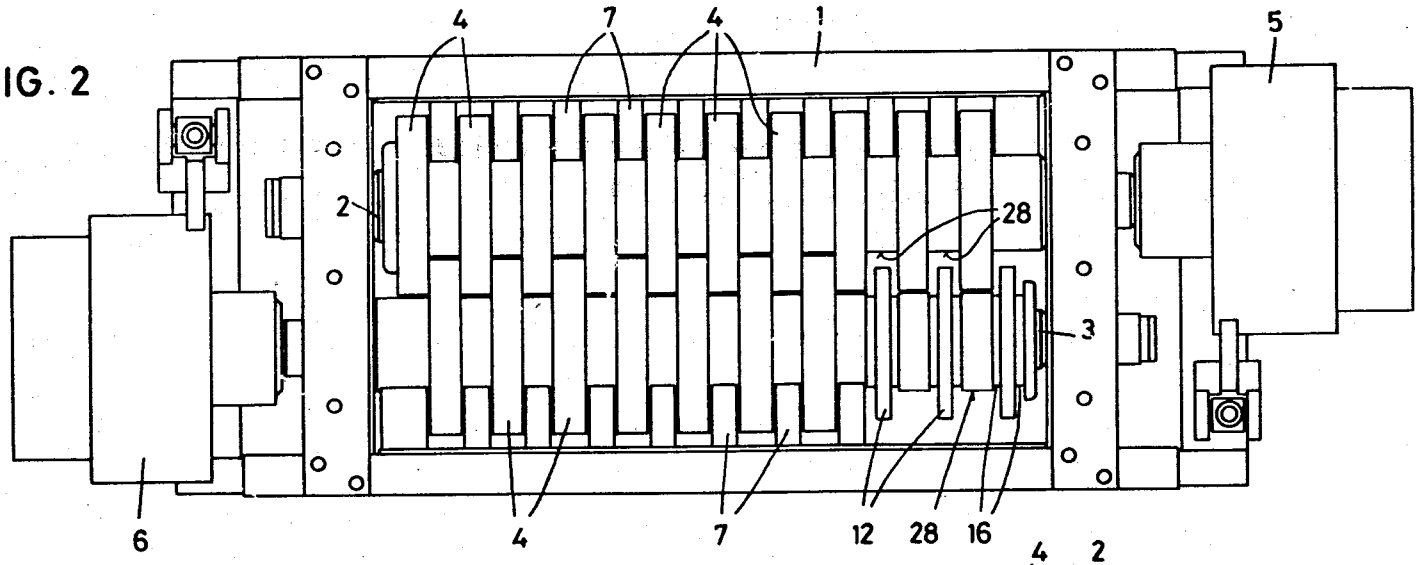

FIG. 3
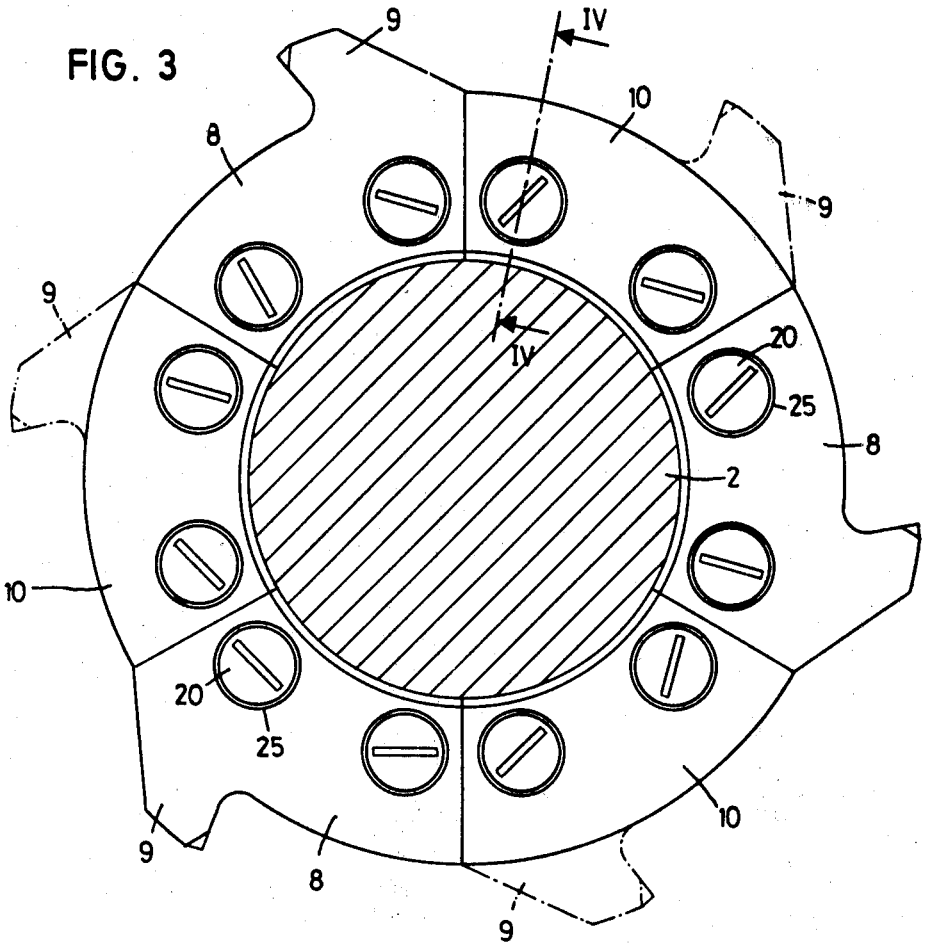
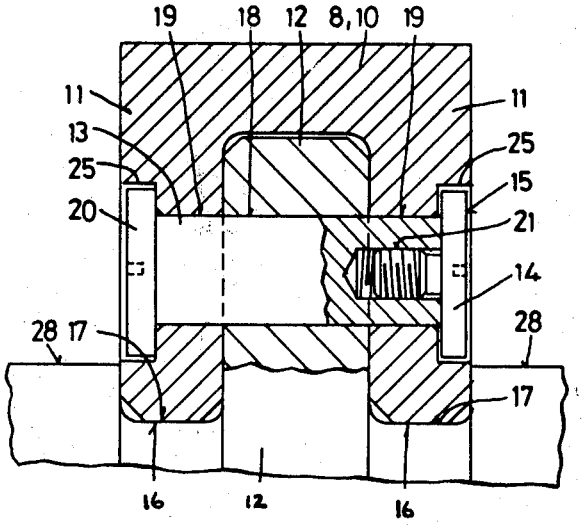
FIG. 4

COMMINUTING MACHINE

This invention relates to a comminuting machine intended for comminuting objects which are bulky and/or resistant to destruction, in particular for parts of vehicle bodies and vehicle tires, of the type having two parallel rotary shafts arranged to rotate in opposite directions and comminutor rings disposed alternatingly along the shafts.

U.S. Pat. No. 3,991,994, granted to the present applicant, discloses comminuting apparatus of the abovementioned type. Various designs for the comminutor rings are proposed in the specification of this patent. One such proposal consists in anchoring cutting-noses or knives in an annular part slipped over one of the shafts and made integral therewith by giving both the shaft and the matching opening in the annular part a hexagonal profile. A further proposal consists in forming the ring of separate elements, each in the shape of a sector of an annulus, these elements being directly anchored in suitable grooves on the shaft and interconnected to form a composite ring. Comminuting apparatus constructed according to the latter principle has proved very sturdy; however, it has become evident that because of the extremely heavy axial stresses produced during operation, a communitor ring design affording better radial rigidity would represent a very appreciable improvement. For taking into account the very great mechanical stresses acting both axially and radially, it would be highly advantageous if the breaking-strength, i.e., the resistance to the risk of breakage and/or inadmissible deformation, were of the same order of magnitude both radially and axially, if possible.

It is an object of this invention to provide a comminuting machine which answers this need by exhibiting a very high breaking-strength of the comminutor rings in the axial direction as well as in the radial direction.

To this end, in the comminuting machine according to the present invention, of the type initially described, the improvement comprises comminutor rings formed of separate elements, at least some of which are comminutor elements provided with cutter-noses, all of the elements having a cross-sectional profile in the shape of an inverted U, giving them the form of a cowling adapted to fit over an annular shaft-collar projecting outwardly from and integral with each shaft at a location where a ring is to be mounted on the shaft, each element thus having two sidewalls situated one on each side of the shaft-collar, and securing members passing through the sidewalls of the elements and the shaft-collar for securing the elements forming the ring firmly to the shaft, the axial pressure of the sidewalls of the elements against the shaft-collar ensuring the resistance of the rings to axial mechanical stresses arising during operation.

Depending upon the circumstances, either all of the elements may be comminutor elements having cutter-noses, or only some of these elements are such comminutor elements, the rest being spacer elements inserted between the comminutor elements.

In an embodiment having the advantage of being particularly sturdy in all respects while remaining relatively simple in concept and quite easy to produce, the securing means are composed of journals which are smooth on the outside, provided with a tapped hole, and include an outer collar at one end forming a journal head, a cylindrical-head screw screwed tight into the tapped hole at the other end of the journal, this screw having a head-forming portion which extends beyond the diameter of the journal, the sidewalls of the elements comprising matching axial bores of the same diameter, with an outer recess of the required depth and diameter to receive the head of the screw and the head of the journal, respectively, the pre-stressed journal-and-screw assembly being accommodated in the bores in the shaft-collar and in the sidewalls of the elements, the heads of the screw and the journal being entirely within the recesses in the sidewalls, but without axial tightening.

Particularly high breaking-strength with respect to radial stresses is obtained by providing in each element at least two bores near the ends of the elements, the position of the bores in the sidewalls and the shaft-collar being determined in such a way that when the element is secured to the shaft-collar, the edges of the element sidewalls, each forming an inner cylindrical surface portion, rest against respective outer cylindrical bearing surfaces of the shaft situated at the base of the shaft-collar.

In order to achieve substantially equal sturdiness of the various components subjected to heavy mechanical stresses, the shaft-collars are slightly thicker than one-third of the thickness of a ring, while each of the two sidewalls is slightly thinner than one-third of the thickness of the ring, which corresponds to the total thickness of the elements.

Figure 1:
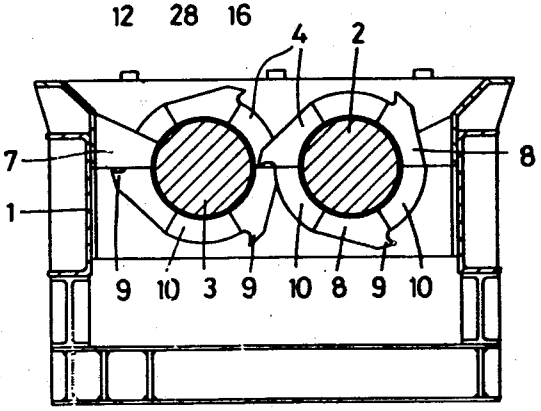
Figure 3A:
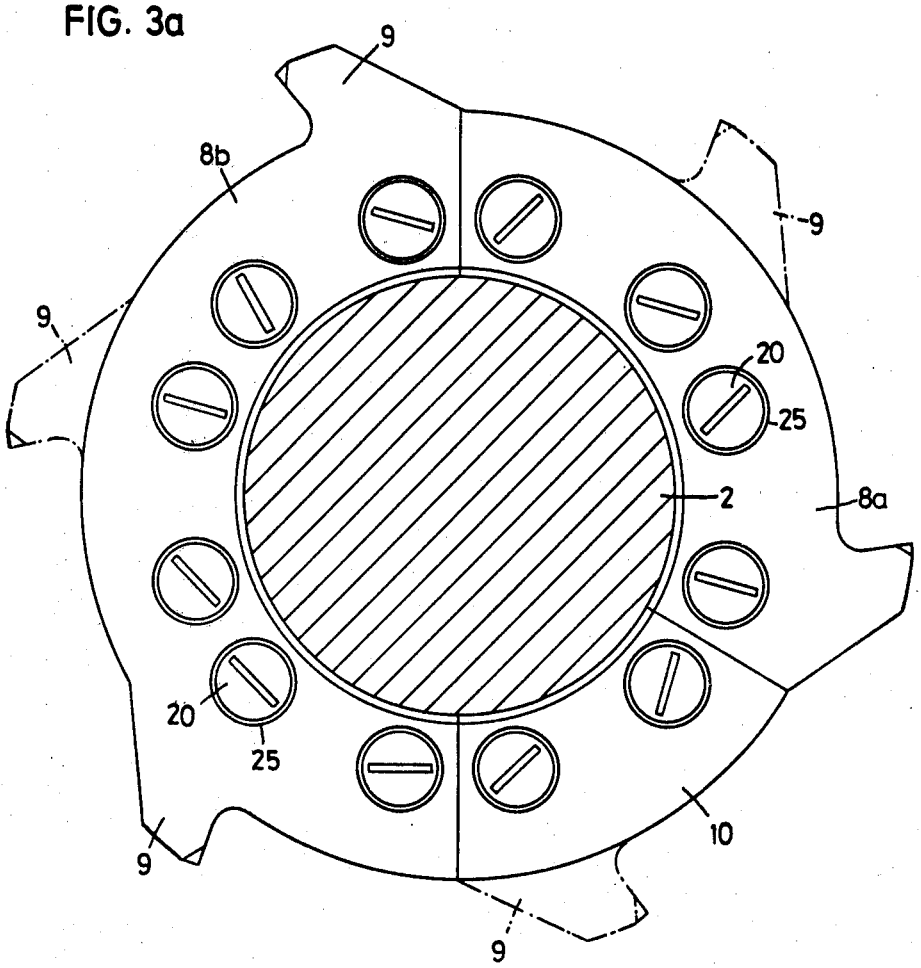

A preferred embodiment of the invention will now be described in detail with reference to the accompanying drawings, in which:

FIG. 1 is a general cross-sectional view of a comminuting machine of the type in question, FIG. 2 is a general plan view of the comminuting machine of FIG. 1, the lower right-hand portion of FIG. 2 showing in more detail, however, a structural particularity of the comminuting machine, namely, the form of a ring-bearing shaft as it appears without the rings thereon, three rings of a shaft having been omitted from this portion of FIG. 2 for that purpose, FIGS. 3 and 3*a* are sections showing a composite ring (with various modifications) mounted on a shaft, the latter being visible in cross-section on these figures, and FIG. 4 is a sectional view, in a radial-axial plane indicated by the line IV—IV in FIG. 3, of the arrangement of a U-profile element inverted upon a shaft-collar of the shaft, to which shaft-collar this element is secured by pre-stressed journal-and screw assemblies.

In FIGS. 1 and 2, the comminuting machine will be seen to comprise a frame 1, made of sections and sheet-metal, preferably steel, on which two rotary shafts 2 and 3 are mounted for rotation, each bearing a plurality of comminutor rings 4 disposed alternatingly along the respective shafts. Shafts 2 and 3 are driven by motors 5 and 6, preferably hydraulic motors, shown diagrammatically in FIG. 2.

Projecting from the sides of frame 1, at the locations corresponding to the spaces between the adjacent rings 4 of these sides, are combs 7 which prevent the comminuting material from rising laterally toward the top of the comminuting machine in the event that such material should have a tendency to adhere to shafts 2 and 3 and to comminutor rings 4.

The general make-up and mode of operation of a comminuting machine such as is shown in FIGS. 1 and 2 being known (especially from the aforementioned U.S. Pat. No. 3,991,944), the particular construction of the comminutor rings in the comminuting machine according to the present invention will now be described with reference to FIGS. 3, 3*a*, and 4.

It will be seen from FIG. 3 that a ring is composed, for example, of three closely adjacent comminutor elements 8 having cutter-noses 9, between which there are three spacer elements 10 without cutter-noses. As a modification as shown in dot-dash lines in FIG. 3, there could be six comminutor elements 8 having cutter-noses 9, this being a question of suitability, the choice of the appropriate solution depending upon the material to be comminuted.

It will be noted, however, that as shown in FIG. 3*a*, a ring might equally well be composed of three comminutor elements 8*a*, each corresponding to one-third of the ring, or even of two comminutor elements 8*b*, each corresponding to half a ring.

All of the elements, i.e., both comminutor elements 8, 8*a*, 8*b* and spacer elements 10, have the profile shown in FIG. 4. This profile is an open-ended groove or trough whose cross section is substantially the shape of an inverted U, and it will be seen that it gives each element the form of a cowling having two sidewalls 11. Furthermore, shafts 2 and 3 comprise a plurality of annular shaft-collars 12 integral with said shafts and distributed along said shafts at a longitudinal pitch corresponding to that of comminutor rings 4, the width (axial dimension) of shaft-collars 12 corresponding exactly to the width of the gap between the sidewalls 11 of the inverted-U-shaped elements 8 and 10. Thus, each element 8 or 10 is slipped over a portion of a shaft-collar 12, sidewalls 11 coming to rest axially against the side surfaces of the shaft-collar.

Elements 8, 10 are secured to shaft-collar 12, and hence to shafts 2 and 3, by means of journal-and-screw assemblies 13/14 to be described in detail below.

At the base of each shaft-collar 12, on each side thereof, shafts 2 and 3 include cylindrical bearing surfaces 16 of a precisely determined diameter, against which concave (or inner) cylindrical surfaces 17 along the edges of sidewalls 11 of elements 8 and 10 come to rest, thus firmly defining the position of the element on the shaft and on the shaft-collar. Precision bores 18 are made through shaft-collar 12 at twelve locations distributed around the circumference, as may readily be seen from FIG. 3, i.e., disposed near both ends of each of six equal sectors. Bores 19, of identical diameter and spacing, are made through sidewalls 11 of sectors 8, 10, near the ends thereof. As shown in FIG. 4, bores 18 and 19 coincide exactly in shaft-collar 12 and sidewalls 11 of elements 8, 10 disposed thereon, so that each element 8, 10 is made firmly integral with shaft-collar 12 and shaft 2, 3 supporting it. The thickness of shaft-collars 12 and that of sidewalls 11 of elements 8, 10 are such as to make the anchoring of the elements on shafts 2, 3 as resistant as possible, especially to axial mechanical stresses. For this purpose, shaft-collar 12 is slightly thicker than one-third of the total thickness of a ring 4, while sidewalls 11 are slightly thinner than one-third of the total thickness.

Since the bases 17 of elements 8, 10 rest against bearing surfaces 16 of shafts 2, 3, a slight tolerance play is left, to facilitate manufacture, at the location where the outer circumference of shaft-collar 12 meets the top of the gap in the inverted U-shaped element 8, 10.

Journals 13 are smooth on the outside and correspond in diameter to bores 18 and 19 of shaft-collar 12 and sidewalls 11. Each journal 13 comprises a central tapped hole 21 accommodating a screw 14. At one end, journal 13 comprises an outwardly projecting collar forming a journal head 20.

The head 15 of screw 14 is analogous to journal head 20. The sidewalls 11 of elements 8, 10 comprise recesses 25 at the mouths of bores 19, intended to receive journal head 20 and screw head 15, respectively, in their entirety.

Journal-and-screw assembly 13, 14 forms a pre-stressed unit, screw 14 being traction-biased and journal 13 being shear-biased; this pre-stressing ensures locking of the two parts relative to one another, i.e., it eliminates the risk of screw 14 coming unscrewed from journal 13. Thus, there is gripping between screw 14 and the end of journal 13, but there is no gripping of journal heads 20 and screw heads 15 against the bottoms of recesses 25 in sidewalls 11.

In order to secure the connection between screw 14 and journal 13, the latter comprises a tapped hole 21 of sufficient length according to the rules of mechanical design relating to the strength of materials. It will be noted that for the sake of convenience, screw head 15 is slotted.

It will be obvious that, like comminutor elements 8 and, preferably, spacer elements 10 as well, journal-and-screw assembly 13, 14 is made of high-grade steel.

It will also be noted that opposite comminutor rings 4, shafts 2, 3 comprise smooth cylindrical surfaces 28 acting as "anvils" for the comminuting and cutting action of cutter-noses 9 of the rings 4 facing them.

The positioning of bores 18 through shaft-collars 12 and bores 19 through element sidewalls 11 must be very precise, just as the diameter of these bores must correspond precisely to the outside diameter of journals 13. Present-day technology includes machining means which, with certain precautions, make it possible to produce these bores with the very narrow tolerance of diameter and positioning required.

The shape of cutter-noses 9 may be determined according to the different possibilities already known from prior art comminuting machines, depending upon the nature of the materials to be comminuted. With the design described herein, it is possible to change a single element if it becomes damaged, without having to dismantle the rest of the elements. It is likewise possible to provide comminutor elements having different types of noses on one ring; and it is possible, too, to provide different numbers of comminutor elements, naturally on condition that all the comminutor elements and spacer elements together always form a complete circumference.

In the embodiment described, which corresponds to a reduction to practice giving complete satisfaction, especially as regards its sturdiness and resistance to axial and radial stresses, six elements per ring have been provided. It would, of course, be possible to envisage other embodiments comprising a different number of elements per ring, at least two elements, and preferably at least three, being implicit in the design in question.

With the increased rigidity of axial positioning of the rings provided by the present invention, it is preferable to use hydraulic motors equipped with overload detectors for stopping or reversing the rotation of the shafts if it should happen that a piece of material to be comminuted is too hard or resistant and tends to block the operation of the comminuting machine. This equipment thus prevents damage to the rings and the cutter-noses. Such safety devices are described in the aforementioned U.S. patent and are naturally built into the comminuting machine according to the present invention as well in such a way as to be fully effective.

What is claimed is:

1. In a comminuting machine for comminuting objects which are bulky and/or resistant to destruction, especially parts of vehicle bodies and vehicle tires, of the type having two parallel rotary shafts arranged to rotate in opposite directions and comminutor rings disposed alternatingly along said shafts, the improvement comprising:

a plurality of annular shaft-collars projecting outwardly from and integral with said shafts at the respective locations of each of said comminutor rings, a plurality of ring-forming elements fitted in closely adjacent relation to one another over associated said shaft-collars to form said comminutor rings, each of said elements having a cross-sectional profile in the shape of an open-ended inverted U comprising two sidewalls which are situated respectively one on each side of an associated shaft-collar, each of said shaft-collars extending continuously through the open ends of said inverted U cross-sectional profiles from one to the next adjacent one of the elements on said shaft-collar, at least some of said elements including cutter-noses, and a plurality of securing members passing through said sidewalls and through said shaft-collars for securing each of said elements to said associated shaft-collars and hence to said shafts, whereby the axial pressure of said sidewalls against said shaft-collars ensures the resistance of said comminutor rings formed of said elements to axial mechanical stresses.

2. The comminuting machine of claim 1, wherein all of said ring-forming elements include said cutter-noses.

3. The comminuting machine of claim 1, wherein certain of said ring-forming elements are comminutor elements including said cutter-noses, the remaining said elements being spacer elements inserted between said comminutor elements.

4. The comminuting machine of claim 1, wherein said shaft-collars and said sidewalls include matching bores, said sidewalls further including outer recesses situated at the mouths of said bores, and wherein said securing members each comprise a journal having smooth outer walls, a centered tapped hole in one end, and an outer collar forming a journal head at the other end, and a cylindrical-head screw screwed tight into said tapped hole against said one end of said journal, said screw including a head-forming portion of larger diameter than said journal, said journal and said screw forming a prestressed assembly accommodated within said bores, said journal head and said head-forming portion of said screw being entirely accommodated in respective said recesses with slight axial play.

5. The comminuting machine of claim 4, wherein said side walls each include at least two said bores near the ends thereof.

6. The comminuting machine of claim 4 or claim 5, wherein said shafts include outer cylindrical bearing surfaces adjacent to said shaft-collars and said sidewalls include matching cylindrical surface portions along the edges thereof facing said shafts, said matching bores of said shaft-collars and said sidewalls being so positioned that said elements are secured to said shaft-collars with said cylindrical surface portions of said sidewalls bearing against said cylindrical bearing surfaces of said shafts.

7. The comminuting machine of claim 1, wherein the axial spacing of said comminuting rings on said shafts is substantially equal to the axial thickness of one of said comminuting rings.

8. The comminuting machine of claim 7, wherein each of said shaft-collars is slightly more than one-third the thickness of one of said comminuting rings, each of said sidewalls being slightly less than one-third of said thickness.

* * * * *